US007908991B2

(12) United States Patent
Woods et al.

(10) Patent No.: US 7,908,991 B2
(45) Date of Patent: Mar. 22, 2011

(54) AIR POWERED SIGNALING SYSTEM

(75) Inventors: David Woods, Victoria (CA); Scott Johnson, Victoria (CA); Ian Soutar, Victoria (CA)

(73) Assignee: Woodscan Industries, Inc., Victoria, B.C. (CA)

( * ) Notice: Subject to any disclaimer, the term of this patent is extended or adjusted under 35 U.S.C. 154(b) by 140 days.

(21) Appl. No.: 12/340,423

(22) Filed: Dec. 19, 2008

(65) Prior Publication Data

US 2010/0154699 A1 Jun. 24, 2010

(51) Int. Cl.
*G10K 9/02* (2006.01)

(52) U.S. Cl. ..... 116/142 FP; 116/137 R; 116/3

(58) Field of Classification Search ..... 116/3, 137 R, 116/138, 139, 142 FP, 142 FV; 340/404.1, 340/404.2, 404.3
See application file for complete search history.

(56) References Cited

U.S. PATENT DOCUMENTS

| | | | | |
|---|---|---|---|---|
| 1,760,295 | A * | 5/1930 | Aufiero | 116/142 FP |
| 3,725,886 | A * | 4/1973 | Marks | 340/539.26 |
| 4,084,157 | A * | 4/1978 | Jacoby | 340/517 |
| 5,022,341 | A * | 6/1991 | Eveanowsky et al. | 116/142 FP |
| 5,131,612 | A * | 7/1992 | Skantar | 246/107 |
| 5,836,302 | A * | 11/1998 | Homuth et al. | 128/205.23 |
| 5,864,517 | A * | 1/1999 | Hinkey et al. | 367/145 |
| 7,063,040 | B2 | 6/2006 | Woods | |
| 7,256,685 | B2 * | 8/2007 | Gotfried | 340/384.3 |
| 7,394,351 | B2 * | 7/2008 | Solow | 340/426.23 |
| 2007/0272144 | A1 * | 11/2007 | Tomassetti et al. | 116/3 |

FOREIGN PATENT DOCUMENTS

DE 202006007828 U1 * 10/2007

* cited by examiner

*Primary Examiner* — R. A. Smith
(74) *Attorney, Agent, or Firm* — Todd Lorenz; Arnold & Porter LLP

(57) ABSTRACT

A portable air horn apparatus includes a housing, an air horn assembly for generating a warning sound, a switch for activating the air horn assembly and a power source. A microprocessor is provided in communication with the switch, the air horn assembly and the power source. The microprocessor includes at least one port for receiving an electronic component and is capable of automatically loading and executing software of the electronic component.

10 Claims, 9 Drawing Sheets

AIR POWERED SIGNALING SYSTEM

TECHNICAL FIELD

The present invention relates to air horns used to provide warning sounds over wide distances and, in particular, motor driven portable air horns.

BACKGROUND

Air horns are commonly used as warning devices because they are capable of providing very loud and distinctive sounds that carry over large distances. For example, air horns are used in the mining and construction industry to provide warnings when blasting is about to take place and to signal all clear after such operations have concluded. In addition, air horns are used in emergency situations when an accident on a worksite has occurred. Some occupational health and safety regulations mandate the use of signaling in certain situations.

A very common kind of portable air horn apparatus consists of an air horn attached to a valve device that can be fitted to the neck of a compressed gas canister. The valve device includes a trigger that, when operated, allows compressed gas from the canister to operate the air horn. Devices of this kind are relatively inexpensive and lightweight and can generate sound at a high volume. However, gas canisters contain a finite amount of compressed gas that allows only a few uses before the canister has to be changed. Even worse, the valve devices tend to allow leakage of the gas from the canisters, thus further reducing the number of uses of the device before replacement of the canister is necessary. Gas leakage can also lead costly or dangerous situations in which an apparatus is unexpectedly found to be inoperative due to leakage and necessary warnings cannot be given, at least until a new canister can be obtained. The unreliability of apparatus of this kind makes it unsuitable for professional use.

There is consequently a need for more reliable and effective apparatus of this kind.

SUMMARY

According to an embodiment of the present invention, there is provided, a portable air horn apparatus including: a housing; an air horn assembly for generating a warning sound, the air horn being mounted in the housing and receiving pressurized air from a compressor, the compressor being operable by a motor; a power source; a switch for selectively operating the motor using the power source; a microprocessor in communication with the switch, the air horn and the power source, the microprocessor including at least one port for receiving an electronic component; and wherein the microprocessor is capable of automatically loading and executing software of the electronic component.

According to another embodiment of the present invention, there is provided a portable air horn apparatus including: a housing; an air horn assembly for generating a warning sound, the air horn being mounted in the housing and receiving pressurized air from a compressor, the compressor being operable by a motor; a power source, the power source being removable from the housing; a switch for selectively operating the motor using the power source; a blast initiator unit; a galvanometer; and wherein the blast initiator unit and the galvanometer are provided in the housing of the portable air horn apparatus.

DRAWINGS

The following Figures set forth embodiments of the invention in which like reference numerals denote like parts.

Embodiments of the invention are illustrated by way of example and not by way of limitation in the accompanying Figures.

DETAILED DESCRIPTION OF EMBODIMENTS OF THE INVENTION

Figure 1:
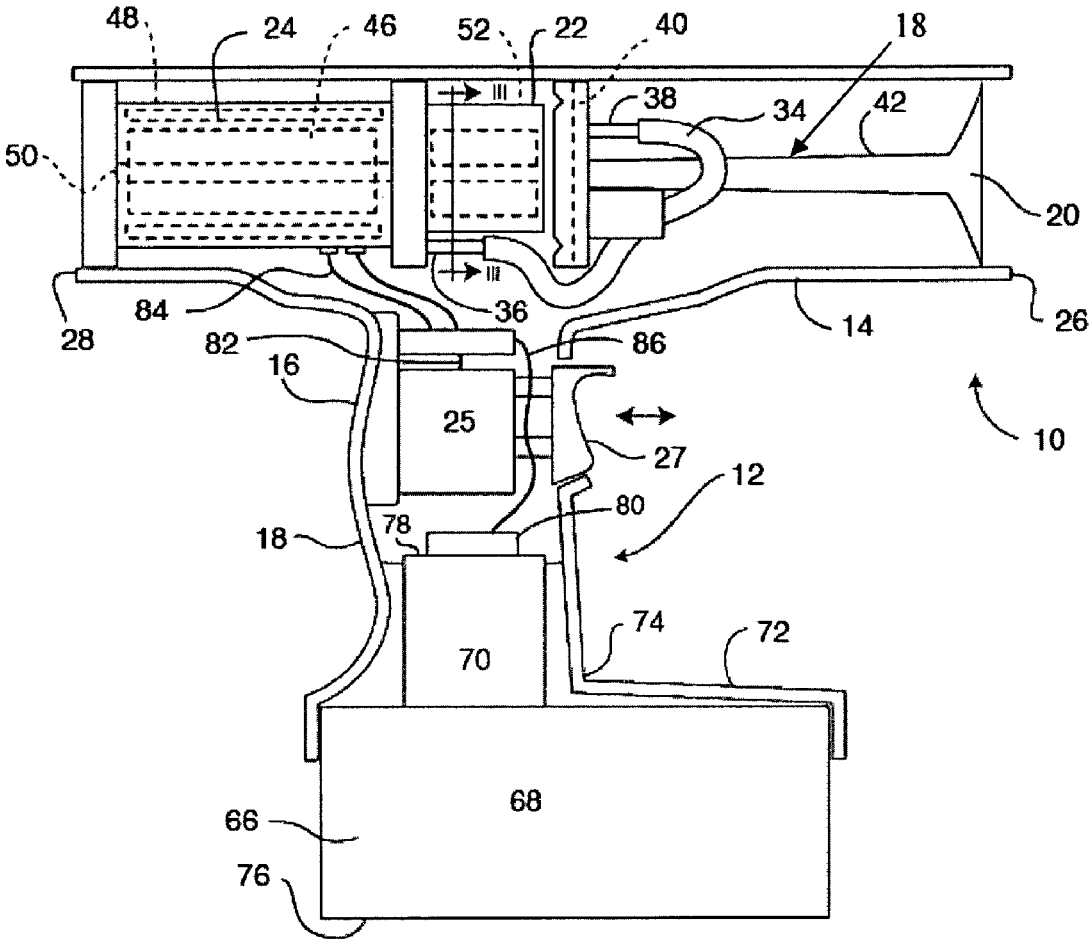
FIG. 1 is a side view of an air horn apparatus according to an embodiment of the present invention with a portion of a housing removed.

The device shown in FIG. 1 of the accompanying drawings is one embodiment of a portable air horn apparatus 10 according to the present invention. The portable air horn apparatus 10 is an improvement on the portable air horn apparatus that is disclosed in U.S. Pat. No. 7,063,040, which is herein incorporated by reference.

The air horn apparatus 10 includes a housing 12 having two main parts that are coupled together along a vertical axis thereof in a "clam shell" type configuration. The air horn apparatus 10 of FIG. 1 is shown with one of the housing parts removed in order to better show the components of the apparatus 10. The housing 12 functions to physically support the components of the apparatus so that they form a unitary whole. The housing 12 also encloses and protects most of the parts and provides an attractive and functional appearance to the apparatus.

The housing 12 is shaped to include an elongated tubular element 14 that is provided at one end of an elongated member 16. The apparatus 10 consequently resembles a pistol with the tubular element 14 forming the "barrel" and the elongated member 16 forming a handle in the form of a "pistol grip" that can be grasped by a user in one hand to carry and operate the apparatus.

The two parts of the housing 12 are made of injection molded plastic and are coupled to one another along their respective edges by fasteners (not shown). The fasteners may be integrated into the two plastic housing parts to form a series of releasable catches, or alternatively, the fasteners may be separate parts, such as screws, for example, arranged to couple the two parts together. The housing 12 may alternatively be made of metal, composite or another suitable material.

The tubular element 14 of the housing 12 includes ends 26 and 28 and generally surrounds an air horn assembly 18. The air horn assembly 18 includes an air horn 20, an air compressor 22, which is in communication with the air horn 20 and an electric motor 24 for operating the air compressor 22.

An inner surface of the housing 12 includes projections (not shown) that define cavities, which are shaped to receive the motor 24, the air compressor 22, the air horn 20 and other components of the apparatus 10. The components may be secured by an interference fit within the cavities or fixed to the housing 12 by fasteners (not shown), such as screws, for example. Alignment posts may further be provided to allow for easy location of the components during assembly.

A flexible hose 34 forms an air conduit for supplying a stream of compressed air from the compressor 22 to the air horn 20. One end of the hose is fitted over a nipple 36 projecting from the compressor and the other is fitted over a nipple 38 that communicates with to the interior of the air horn 20, which contains a vibratable diaphragm 40 that generates a sound that is then amplified by an elongated trumpet element 42. A central region of the hose 34 is secured within a clip 44 attached to the air horn 20 to reduce the likelihood that the hose will become detached at one or both ends during use or transportation.

Figure 2:
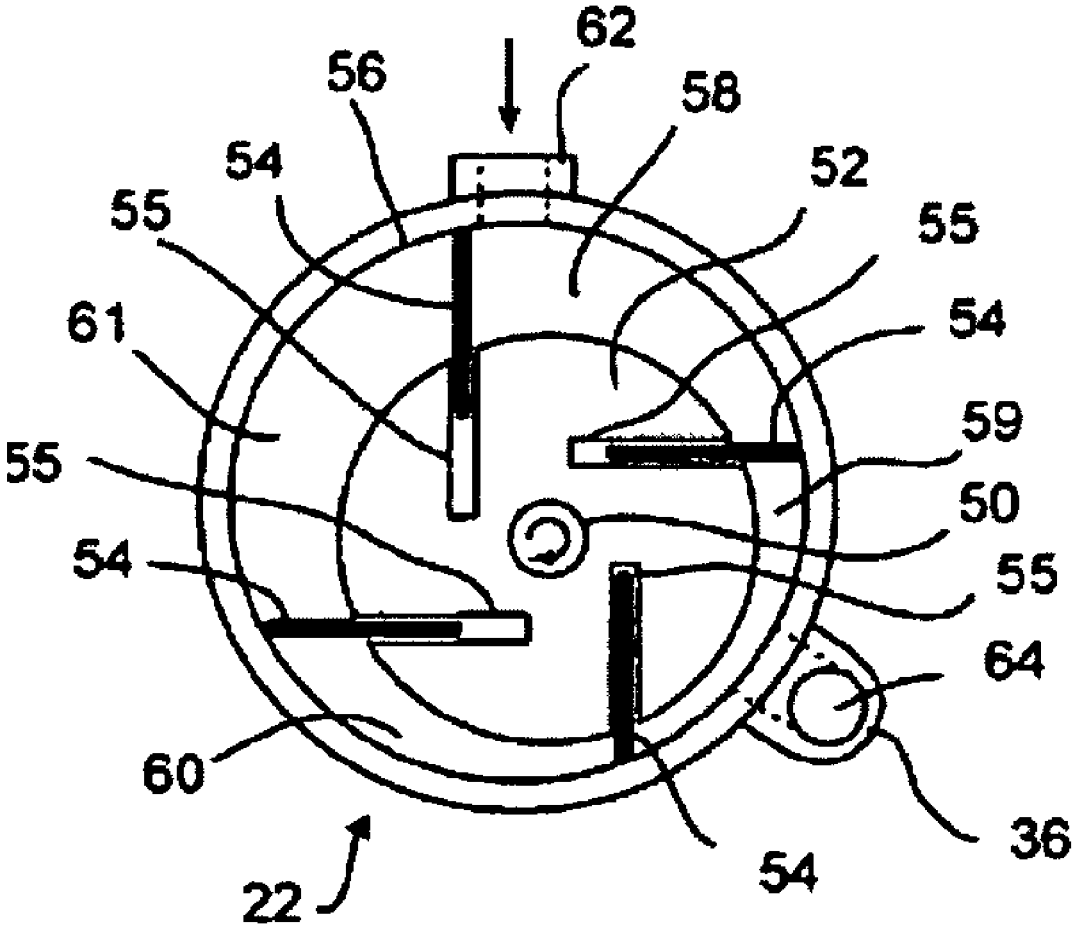
FIG. 2 is a cross-section taken on the line III-III of FIG. 1.

The electric motor 24 is a DC motor having, for example, a conventional armature 46 and magnets 48 illustrated in broken lines. A central shaft 50 extends from the motor into the air compressor 22 to rotate a compressor rotor 52 to pressurize air drawn into the compressor from the exterior. The interior of the compressor 22 is shown in more detail in the cross-sectional view of FIG. 2 and it will be seen that the rotor 52 is provided with four vanes 54 that are slidably held within slots 55 in the rotor. The vanes may move between a retracted position, in which most of the vane is held in the slot, to an extended position, in which most of the vane projects from its associated slot. The rotor 52 is mounted off-center within a chamber 56 within the compressor and the vanes divide the free space within the chamber into four segments 58, 59, 60 and 61. As the rotor rotates, air trapped in segment 58 (which enters the chamber via port 62), is moved around the chamber into a smaller volume formerly occupied by segment 59, the smaller volume being due to the off-centre location of the rotor in the chamber. Consequently, the air is compressed and leaves the chamber 56 through a gas delivery port 64 formed within nipple 36 (see FIG. 1). As the rotor continues to rotate, the free volume increases in segments 60 and 61, so the gas in these segments is reduced in pressure and draws more air into the chamber when connected to the port 62.

A manually operable on-off switch 25 is provided in the elongated member 16 of the housing 12. The manually operable on-off switch 25 is preferably operated by a trigger 27 that can be squeezed by a user's index finger when gripping the handle. The trigger 27 is biased outwardly to the "off" position, and remains in that position until squeezed to the "on" position. Releasing the trigger causes it to return under the spring bias to the "off" position.

The electric motor 24 is energized by a portable energy source 66 when the manually operable trigger 27 is in the "on" position. In turn, the motor 24 drives the compressor 22 and the resulting compressed air is directed to the air horn 20 which creates a piercing sound. Consequently, in use, the user simply squeezes the trigger 25 for as long as the sound is to be made. Releasing the trigger then ends the generation of the sound.

The portable energy source 66 for the apparatus is provided at the lower end of the housing 12. The portable energy source is a rechargeable nano-phosphate lithium-ion battery. Other portable energy sources may also be employed, such as non-rechargeable batteries or fuel cells. It is of course important to use an energy source that is not too bulky or heavy, otherwise the apparatus will not be portable (e.g. transportable by hand by a single user without the need for a vehicle or movable support). Normally, the bulkier and heavier the power source, the longer the apparatus remains powered and ready for use. However, it is generally desirable to make the weight of the power source 2.5 Kg or less (more preferably 1 Kg or less) in order to make the apparatus readily portable.

In the illustrated embodiment, the portable energy source 66 includes a body 68 that is provided with an upstanding elongated projection 70. An upper end 78 of the upstanding projection 70 engages with an electrical connector 80 in order to couple the portable energy source 66 to electrical circuitry of the apparatus 10. The upstanding projection 70 may alternatively be replaced with another arrangement that allows for electrical mating between the portable energy source 66 and the other air horn components. For example, a slide lock system including alignment grooves in the portable energy source 66 and electrical connector 80 may be used.

The body 68 of the portable energy source 66 is provided mostly outside of the housing 12 except for the top edge, which is covered by an enlarged cowling 72 forming a lower end 74 of the housing 12. The cowling 72 removably attaches to the body 68 via releasable catches (not shown) formed on opposite sides of the cowling 72 and engaging opposite sides of the energy source 66. The portable energy source 66 can therefore be removed from the housing 12 when desired and replaced or returned as needed. The body 68 includes a flat lower surface 76 so that the portable energy source may act as a stand for the apparatus when placed on a flat support. Additionally, when the portable energy source is a rechargeable battery, the lower surface may also be provided with contacts (not shown) for electrical connection to a charging device or docking station of a known kind. Alternatively, the portable energy source or the housing 12 may have a socket for connection to a source of current for recharging the portable power source from a suitable charger.

Figure 3:
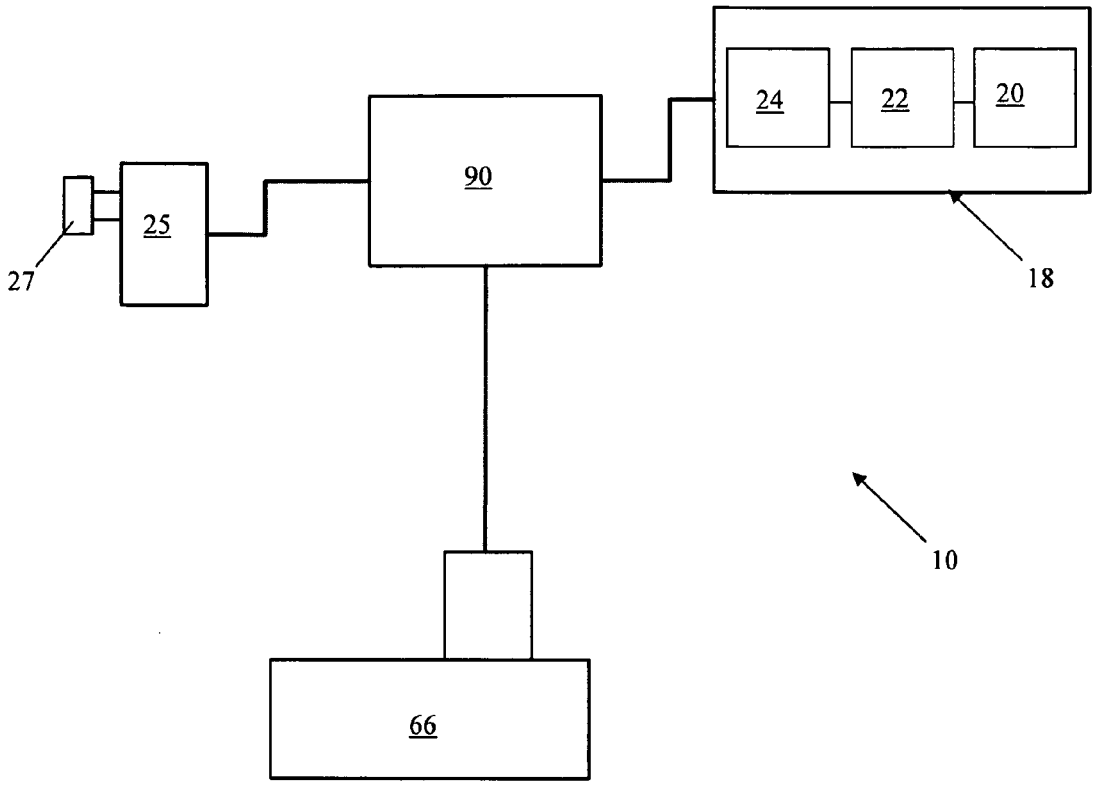
FIG. 3 is a block diagram of some components of the air horn apparatus of FIG. 1.

Referring also to FIG. 3, a microprocessor 90 is mounted in the housing 12 between the switch 25 and the motor 24. The microprocessor 90 is part of a signaling switching circuit that manages air horn signaling control. Electrical communication between the microprocessor 90 and the switch 25, the motor 24 and the power source 66 occurs via wires 82, 84 and 86, respectively.

The microprocessor 90 is a plug-and-play type microprocessor and includes multiple ports (not shown) to allow for integration of various electronic components. The plug-and-play functionality of the microprocessor allows for automatic loading and execution of software when an electronic component is connected thereto. The microprocessor may also include USB connection capability. Plug-and-play type microprocessors are well known in the art and, therefore, will not be described further here.

In operation, manual actuation of the trigger 27 of the switch 25 causes a signal to be sent to the microprocessor 90. The microprocessor 90 receives the signal and sends a signal to the motor 24 of the air horn assembly 18 to turn the motor 24 on. Upon receipt of the signal, the motor 24 drives the air compressor 22, which in turn operates the air horn 20. The microprocessor 90 draws power from the portable power source 66 to operate the switch 25 and air horn assembly 18. As will be appreciated, when switch 25 is actuated, the motor 24 will be energized and the air horn will sound.

It will be appreciated by a person skilled in the art that the trigger 27 may be any type of trigger 27 that activates the switch 25. The trigger 27 may be an electronic trigger 27 or a manual trigger 27. The trigger 27 may be depressed and held for the duration of the sound or, alternatively, the trigger 27 may be depressed and released to generate a sound having a predetermined length.

The air horn apparatus 10 has many different applications including: sub-surface and open pit mining, metals and minerals processing, oil and gas applications, plant safety, forestry, general and heavy construction, blasting and demolitions, site excavation and preparation, seismic surveying, general site safety and security, crowd management and control, wildlife management and control, military, security, search and rescue, disaster relief and response, rapid response kits and professional sports.

The air horn apparatus 10 may also be used in heavy transportation including rail, aerodome, dockyard and logistics yard, for example, aerial construction and assembly including high steel, concrete forming, transmission line or tower assembly, for example, large scale manufacturing including ship building, rail manufacturing, automobile manufacturing and aerospace and aircraft manufacturing, for example, fisheries and other marine applications including log booming, tug, spill recovery and research, for example.

In addition, the air horn apparatus 10 may be used in large facility management and safety including prisons, research facilities, test facilities, firing ranges, storage yards and logistics, for example, events including auto and yacht racing, pro tournaments, Olympics and X games, for example, emergency services including in facility and on vehicle use for fire, police, homeland security, border patrol and customs, for example.

Figure 4:
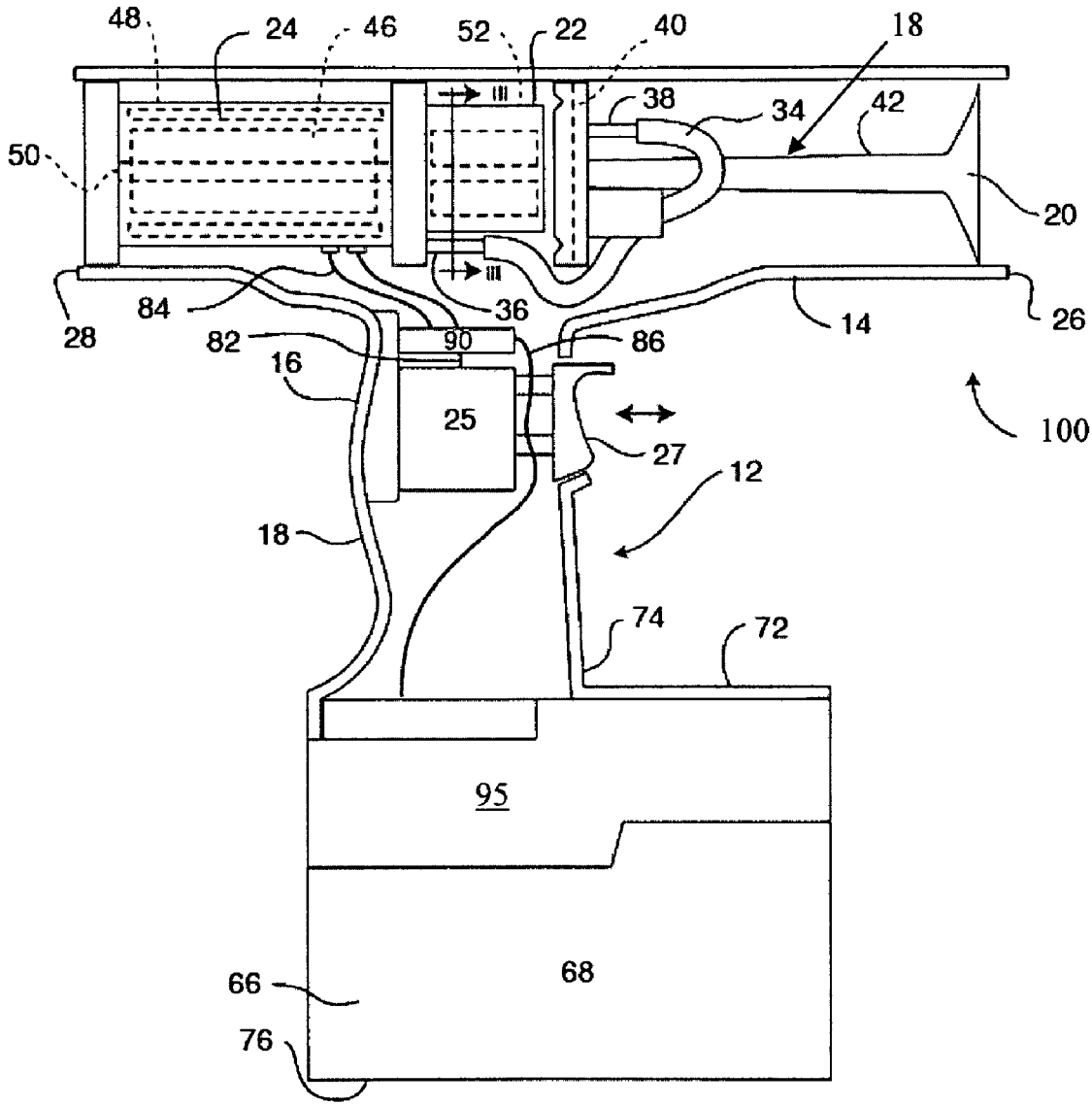
FIG. 4 is a side view of an air horn apparatus according to another embodiment of the present invention with a portion of the housing removed.
Figure 5:
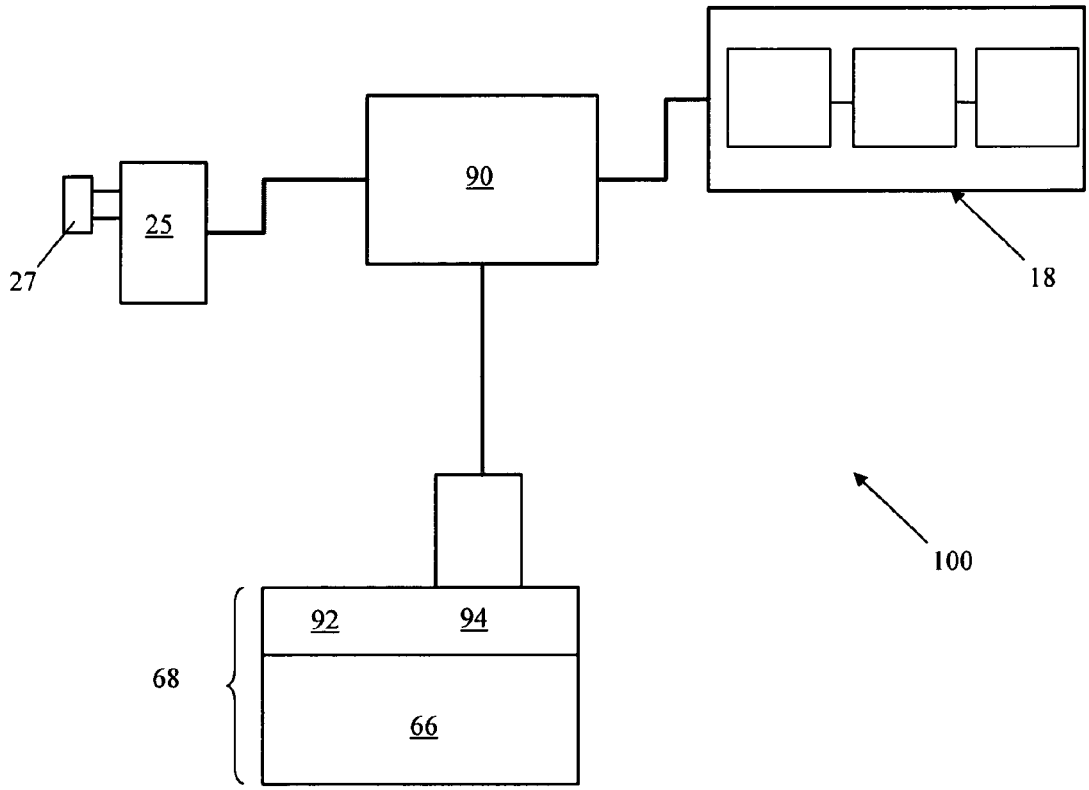
FIG. 5 is a block diagram of some components of an air horn apparatus according to another embodiment.

Referring to FIGS. 4 and 5, another embodiment of an air horn apparatus 100 in which like numerals refer to like parts is generally shown. Similar to the previous embodiment, this embodiment includes a microprocessor 90 that is in communication with the air horn assembly 18, the switch 25, which communicates with the trigger 27, and the portable energy source 66, however, further includes a line continuity galvanometer 92 and a blast initiator device 94. The galvanometer 92 and blast initiator device 94 are provided in a device housing 95, which is coupled to the portable energy source 66 and provided in electrical communication therewith. A snap-glide or similar system (not shown) is provided to couple the device body 95 to the portable energy source 66. The body 68 of the portable energy source 66 and the device housing 95 are intrinsically sealed to meet Mine Health and Safety Administration (MHSA) standards. In this embodiment, the portable energy source 66 is a rechargeable nano-phosphate lithium-ion battery.

It will be appreciated by a person skilled in the art that the galvanometer 92 and blast initiator device 94 may alternatively be provided as independent units that are coupled to the portable energy source 66 between the portable energy source 66 and the lower end 74 of the housing 12. In addition, the galvanometer 92 and blast initiator device 94 may be embedded into the body 68 of the portable energy source 66.

The galvanometer 92 and the blast initiator device 94 are electrically linked to the microprocessor 90, which monitors operation thereof, however, both the galvanometer 92 and blast initiator device 94 are operable independent of the air horn apparatus 100. The galvanometer 92 is used to ensure line continuity of a blast circuit as well as to determine the resistance between various points in the circuit. The resistance is checked against a reference resistance and when an operator is satisfied that the blast circuit is going to operate as desired, the operator uses the blast initiating device 94 to trigger the blast.

The blast initiator device 94 includes a charge button (not shown) and a fire button (not shown) as well as a multi-color LED (not shown), which indicates the status of the system: charging or ready to fire. The galvanometer 92 includes an LCD display (not shown) that shows the operator line volts, provided in milliamps, and a button for initiating the circuit check. Two positive and negative terminal posts (not shown) are provided for coupling a blasting wire thereto. In addition to being used by the galvanometer 92, the blast initiator device 94 utilizes the terminal posts for circuit connectivity.

Integration of the galvanometer 92, blast initiator device 94 and air horn assembly 18 into a single portable device allows operators to carry and use one device rather than multiple independent, disparate devices, which is the current practice.

It will be appreciated by a person skilled in the art that the galvanometer 92 may be any galvanometer that is suitable for use at a blast site. Alternatively the galvanometer may be replaced by a blasting multimeter or blasting ohmmeter. Further, the galvanometer, blasting multimeter and blasting ohmmeter may be incorporated into a single unit and a selector switch may be provided to allow an operator to choose which device to use.

Because the device housing 95, which includes the galvanometer 92 and blast initiating device 94, is coupled to the portable energy source 66, a unit including the portable energy source 66, the galvanometer 92 and blast initiating device 94 may be provided separately. The unit would be interchangeable with the portable energy source 66 of the air horn apparatus 10 of FIGS. 1, 2 and 3. Therefore, the unit may be sold as an add-on to air horn apparatus' 10 that have already been purchased. It may also be used with air horn apparatus' that do not include a microprocessor 90, such as the air horn apparatus described in U.S. Pat. No. 7,063,040.

The portable energy source 66 including the galvanometer 92 and blast initiating device 94 is suitable for many different applications including blasting applications, pyrotechnics displays and other similar applications.

Figure 6:
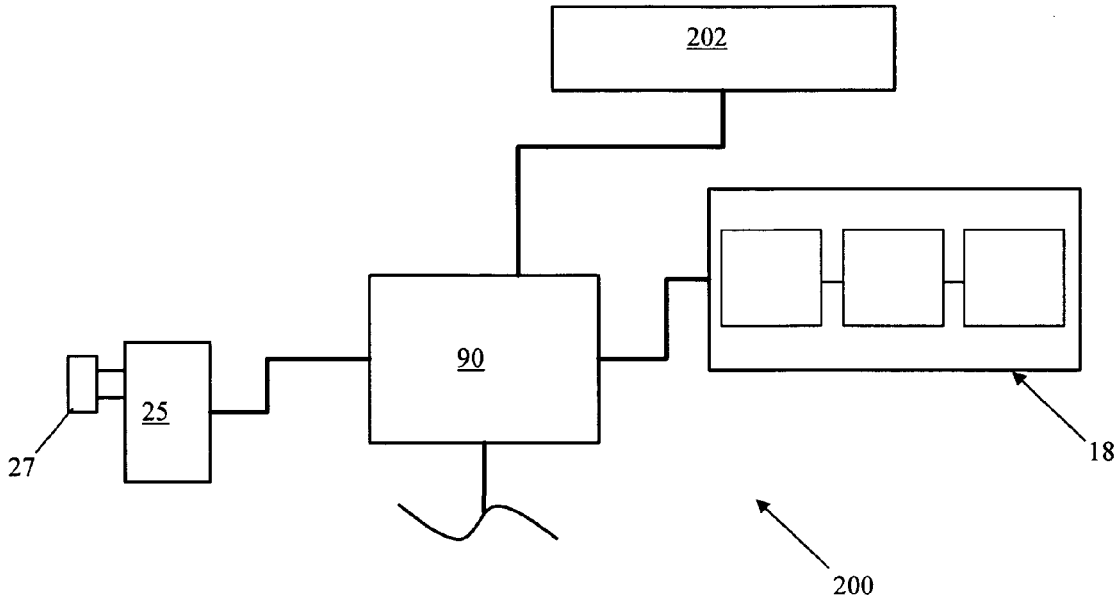
FIG. 6 is a block diagram of some components of an air horn apparatus according to another embodiment.

Another embodiment of an air horn apparatus 200 is shown in FIG. 6. In this embodiment, an air quality sensor unit 202 is provided in communication with the microprocessor 90. The air quality sensor unit 202 is coupled to a port (not shown) of the microprocessor 90 so that software of the air quality sensor 202 may be automatically downloaded and executed thereby.

The air quality sensor unit 202 includes at least one air quality sensor. Types of air quality sensors include: hazardous gas detection sensors for: $H_2S$, CO, TwinTox ($H_2S$), TwinTox (CO), $PH_3$, $SO_2$, $NO_2$, HCN, $CL_2$, $NH_3$, $ClO_2$, $O_3$, IR-$CO_2$, combustibles (0-100% LEL or 0-5.0% Methane gas detection) and oxygen level detection sensors, for example.

In operation, the air quality sensor(s) of the air quality sensor unit 202 detects unsafe breathing conditions automatically. When unsafe breathing conditions are detected, an alert signal is sent to the microprocessor 90 and the air horn assembly 18 emits a warning sound. It will be appreciated by a person skilled in the art that the air horn assembly 18 may be programmed to emit different alert tones depending on the severity of the air quality issue. For example, the air horn assembly 18 may emit repeating short bursts, such as two series of five blasts having a duration of one second each, for a low level alert, or repeating long bursts, such as two series of five blasts having a duration of five to seven seconds each, for high level alerts corresponding to situations posing imminent danger.

It will be appreciated by a person skilled in the art that any number and type of sensors may be provided in the air quality sensor unit 202. Further, sensors may be replaced, added or removed from the unit 202 at any time.

The air horn apparatus 200 of FIG. 6 is suitable for use in any environment where there is a danger of unsafe breathing conditions occurring. Examples include: sub-surface mining or construction, oil and gas applications, disaster response, manufacturing applications where hazardous gases are present, shipping and handling of potentially explosive materials, rail yards, graineries, sugar mills and container ships.

Figure 7:
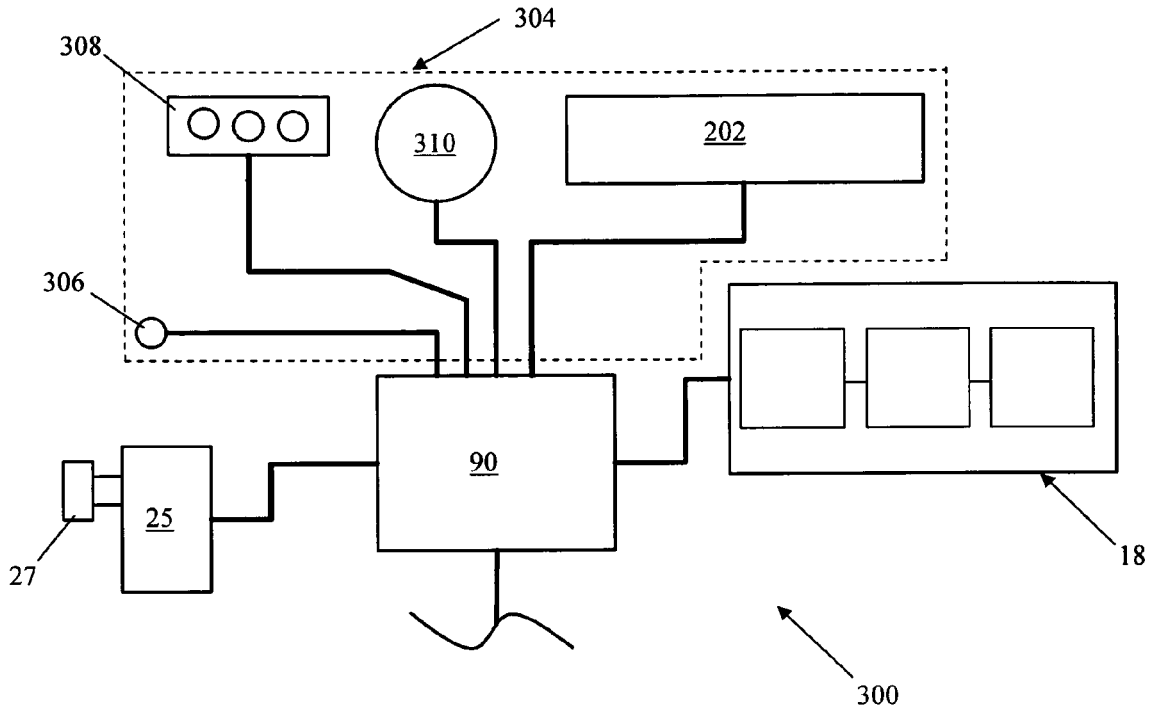
FIG. 7 is a block diagram of some components of an air horn apparatus according to another embodiment.

Referring to FIG. 7, another embodiment of an air horn apparatus 300 is shown. In this embodiment, various electronic components 304 are provided in communication with the microprocessor 90 of the air horn apparatus 300. The electronic components 304 shown include: the air quality sensor unit 202, a battery status indicator light 306, light emitting diode (LED) flood lights 308 and an LED signal strobe 310. Each electronic component 304 is connected to a port (not shown) of the microprocessor 90. Software of the electronic components is automatically downloaded and executed by the microprocessor 90 upon connection of the electronic components thereto.

The battery status indicator light 306 is included to provide an operator of the air horn apparatus 300 with the ability to quickly determine how much battery life is available in the apparatus 300.

The LED flood lights are included in order to provide the apparatus 300 with flood lighting capability. The LED flood lights are particularly useful in explosives storage magazines or other highly volatile atmospheric applications.

The LED signal strobe may be included in the apparatus 300 to provide visual signaling functionality to the apparatus 300. The LED signal strobe would generally be employed in conjunction with the emergency signaling of the air quality sensor embodiment of FIG. 6.

It will be appreciated by a person skilled in the art that the electronic components in communication with the microprocessor 90 are not limited to those shown in FIG. 7. Because of the plug-and-play functionality of the microprocessor, other electronic components 304 may be provided in addition to or instead of the electronic components 304 that have been described. Examples of other electronic components include: a liquid crystal display, a time clock, an elapsed time counter, a radiation detector, a relative humidity gauge, a temperature gauge, a directional display (north/south), a pedometer or distance meter, a decimeter and a geophone (air shockwave), for example.

Figure 8:
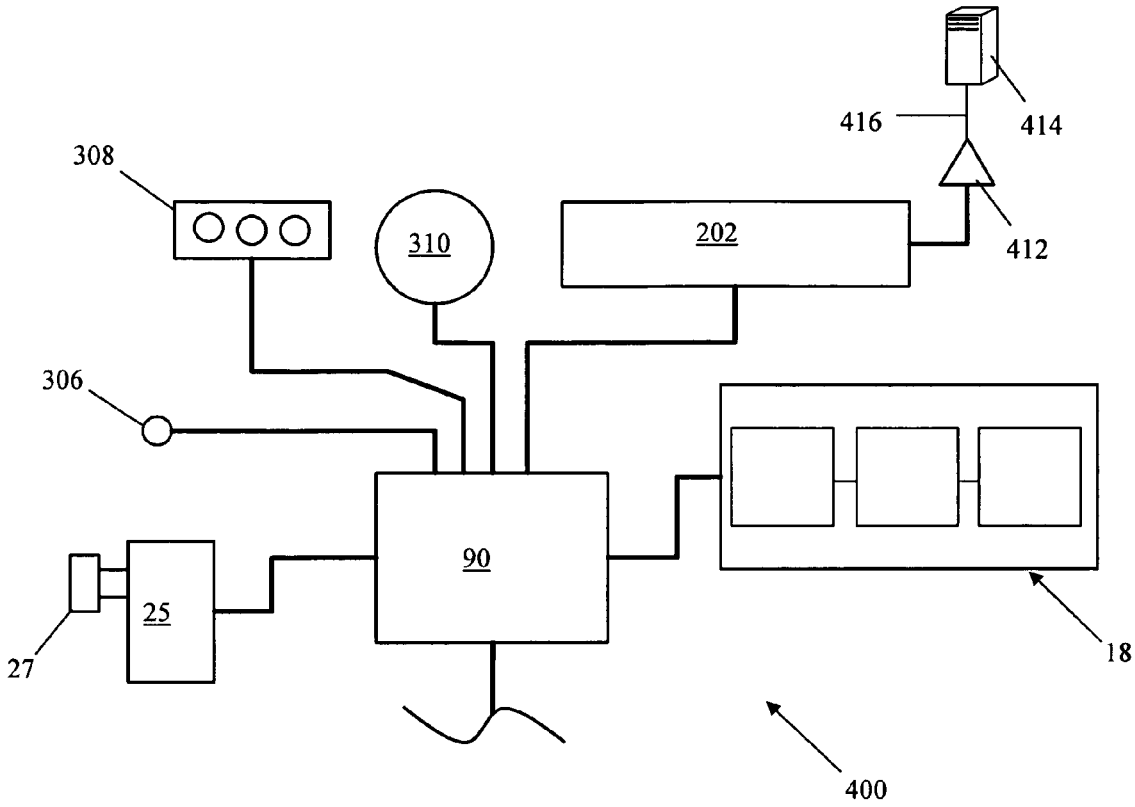
FIG. 8 is a block diagram of some components of an air horn apparatus according to another embodiment.

Referring to FIG. 8, another embodiment of an air horn apparatus 400 is generally shown. In this embodiment, the air quality sensor unit 202 includes a port 412 that is usable for data upload/download, which allows the air quality sensor unit 202 to communicate with a computer 414. Communication with the computer 414 may occur via a cable 416. Alternatively, wireless communication could be initiated with a remotely located computer 414 or a USB data stick that may be plugged into the air horn apparatus 400 to allow for data transfer.

Air quality analysis software is provided on the computer 414 to allow for efficient analysis of the air quality sensor data that is received from the air quality sensor unit 202. The software is stored in the computer memory and may be Linux based or any other suitable format.

In operation, air quality data from the sensor(s) of the air quality sensor unit 202 is uploaded to the computer 414. The software analyzes the data and provides output in a meaningful format for a user. When a wireless connection is used, real time uploading of data is possible so that remote monitoring of a work site may be performed. Downloading of data to the air horn apparatus 400 is also possible and may be used to provide alerts to operators, for example.

Figure 9:
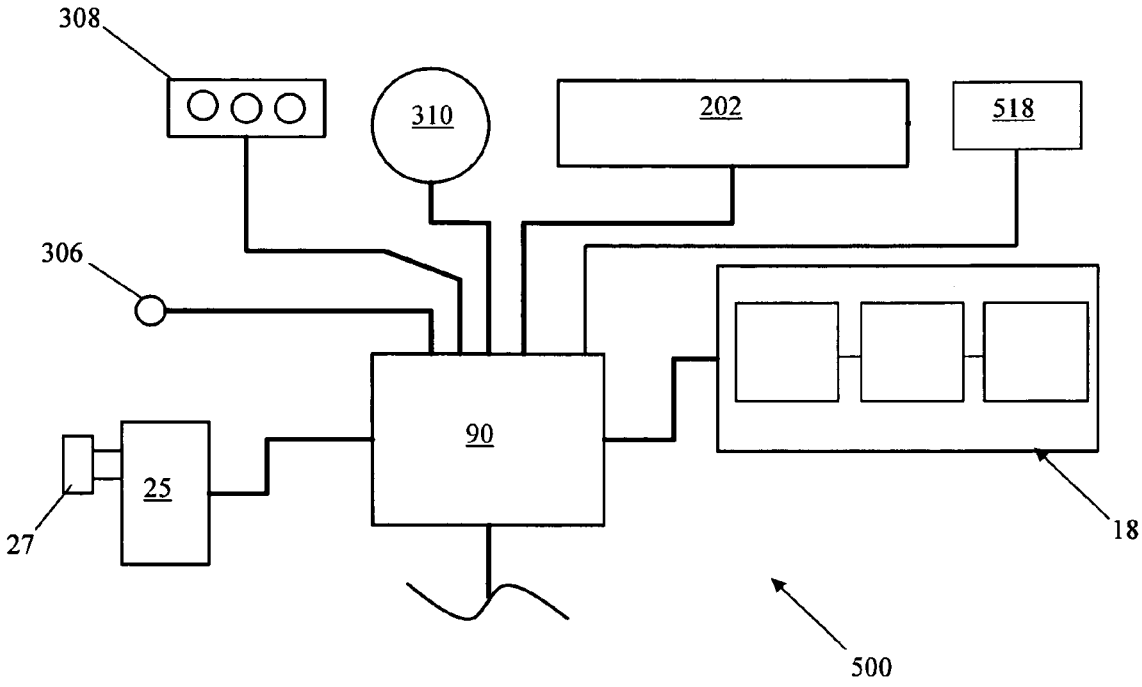
FIG. 9 is a block diagram of some components of an air horn apparatus according to another embodiment.

Referring to FIG. 9, another embodiment of an air horn apparatus 500 is shown. The air horn apparatus 500 includes radio-frequency (RF) communication capability. An RF transmitting and receiving device 518 is embedded in the air horn apparatus 500 and communicates with the microprocessor 90. The RF transmitting and receiving device 518 allows for communication between air horn apparatus' 500.

In one application, the RF transmitting and receiving device 518 is used to substantially simultaneously trigger remote networked alert stations. The alert stations are generally stationary alert stations with integrated conventional air horns or programmable electronic air horns. Alternatively, the alert stations may be other air horn apparatus' 500.

The stationary alert stations include RF transmitting and receiving devices. This allows an all-station alert to be generated when any one alert station is activated. The alert stations may also be arranged at a work site in order to provide a functional alert perimeter, which may further function as a site security system after working hours. The stationary alert stations may be stand or wall mounted. In addition to being used as part of an air horn RF network, it will be appreciated that the stationary alert stations may, alternatively, be used independently.

In another embodiment, the stationary alert stations include an embedded broadcast and Push-to-Talk (PPT) communication link to allow for network-wide two way communications.

It will be appreciated that the stationary alert stations may include air quality sensor units or any of the other electronic components that have been previously described.

The embodiment of FIG. 9 is suitable for multi-station alerting for large open area or segregated zone signaling. Some applications that are suitable for the air horn apparatus 500 include: building or structure implosions, large-shot blasting and disaster alert and work site safety alert stations for multi-level or multi-zone construction projects including high rises, ship building, underground mining and underground construction projects, for example.

Each of the embodiments of FIGS. 1 to 9 has been described as having a housing that is similar to the housing 12 of FIG. 1. It will be appreciated that depending on the environment in which the air horn apparatus is to be used, the housing and the components may be manufactured differently in order to withstand different environmental factors.

In marine environments, inclement weather environments, high humidity environments and fresh water or salt spray applications, for example, an all-weather type of air horn apparatus in which the electrical and electronic components are sealed against admittance of water or moisture is used.

Some applications where the all-weather type housing would be useful include: fisheries, navy or coast guard operations, port operations or port security, offshore oil and gas operations, wildlife control and/or management, search and rescue operations, disaster response operations, underground mining or construction, and special events or professional sports applications, for example.

In industrial environments where explosive vapor protocols are required, the air horn apparatus is intrinsically sealed and manufactured to meet Atmospheric Explosives (ATEX) Directive 94/9/EC and Underwriter's Laboratory (UL) 913 Standards.

Some applications where the adherence to explosive vapor environment protocols may required include: sub-surface mining or construction, oil and gas applications, disaster response, manufacturing environments that include explosive vapors, shipping and handling of potentially explosive materials in environments such as rail yards, graineries, sugar mills and container ships, for example.

It will be appreciated by a person skilled in the art that any of the previously described air horn apparatus embodiments may be provided for use in different environments, such as all-weather or explosive vapor environments. For example, the embodiment of FIG. 6, which includes the air quality sensor unit 202, would generally be provided to meet explosive vapor protocols.

Any of the air horn embodiments described may further be custom branded with logos, custom colors or other visual treatments. Some applications where custom branding may be desired for any of the air horn apparatus' previously described include: professional sporting teams, such as NHL, NFL, NBA and CFL teams, for example, professional sporting events, such as the Olympics, professional golf tournaments, downhill skiing races, auto races, yachting and extreme sporting events, for example. In addition, custom branding may also be suitable for special events including music festivals, charitable events or auctions, for example. The custom branding may be used as a form of advertising for corporate or commercial entities.

In another embodiment, a temperature sensor is provided in communication with the housing 12 and the microprocessor. In this embodiment, the air horn apparatus is operable as long as the temperature detected by the temperature sensor is below a predefined maximum value. A solid state thermal switch may also be provided to protect the electronic components from damage due to overheating of the apparatus.

Specific embodiments have been shown and described herein. However, modifications and variations may occur to those skilled in the art. All such modifications and variations are believed to be within the scope and sphere of the present invention.

The invention claimed is:

1. A portable air horn apparatus comprising:

a housing;

an air horn assembly for generating a warning sound, said air horn being mounted in said housing and receiving pressurized air from a compressor, said compressor being operable by a motor;

a power source;

a switch for selectively operating said motor using said power source;

a microprocessor in communication with said switch, said air horn and said power source, said microprocessor including at least one port for receiving an electronic component wherein said electronic component is one of signal-transmitting air quality sensors and blast initiator devices; and wherein said microprocessor is capable of automatically loading and executing software of said electronic component, and is responsive to signals received from the electronic component.

2. A portable air horn apparatus as claimed in claim 1, wherein said air quality sensor unit includes a hazardous gas detection sensor and an oxygen level sensor.

3. A portable air horn apparatus as claimed in claim 2, further comprising a port for uploading data, said data being provided by said air quality sensor unit.

4. A portable air horn apparatus as claimed in claim 1, wherein said electronic component includes at least one of: LED strobe, LED flood lights and battery indicator light.

5. A portable air horn apparatus as claimed in claim 1, further comprising a radio frequency transmitter communicable with the electronic component and the microprocessor.

6. A portable air horn apparatus as claimed in claim 5, wherein said radio frequency transmitter allows said switch to be remotely actuated.

7. A portable air horn apparatus comprising:

a housing;

an air horn assembly for generating a warning sound, said air horn being mounted in said housing and receiving pressurized air from a compressor, said compressor being operable by a motor;

a power source, said power source being removable from said housing;

a switch for selectively operating said motor using said power source;

a blast initiator unit;

a galvanometer;

wherein said blast initiator unit and said galvanometer are provided in said housing of said portable air horn apparatus.

8. A portable air horn apparatus as claimed in claim 7, wherein said galvanometer and said blast initiator unit are embedded in said power source.

9. A portable air horn apparatus as claimed in claim 7, wherein said galvanometer and said blast initiator unit are coupled to said power source.

10. A portable air horn apparatus as claimed in claim 7, further comprising a microprocessor in communication with said switch, said air horn and said power source, said microprocessor including at least one port for receiving an electronic component and being capable of automatically loading and executing software of said electronic component.

* * * * *